United States Patent [19]

Dashew et al.

[11] 4,214,544

[45] * Jul. 29, 1980

[54] BOAT THRUSTER

[75] Inventors: Stanley A. Dashew, Santa Monica; Charles D. Sutton, Woodland Hills, both of Calif.

[73] Assignee: Omnithruster Inc., Los Angeles, Calif.

[ * ] Notice: The portion of the term of this patent subsequent to Nov. 1, 1994, has been disclaimed.

[21] Appl. No.: 847,222

[22] Filed: Oct. 31, 1977

Related U.S. Application Data

[63] Continuation-in-part of Ser. No. 664,871, Mar. 8, 1976, Pat. No. 4,056,073, which is a continuation-in-part of Ser. No. 491,797, Jul. 25, 1974, abandoned.

[51] Int. Cl.[2] ..... B63H 25/46

[52] U.S. Cl. ..... 114/151; 440/40

[58] Field of Search ..... 114/148, 151; 115/12 R, 115/11, 14, 15, 16; 60/221, 222

[56] References Cited

U.S. PATENT DOCUMENTS

| | | | |
|---|---|---|---|
| 512,591 | 1/1894 | Walker | 115/15 |
| 514,527 | 2/1894 | Wauters | 115/116 |
| 3,121,994 | 2/1964 | Aldropp | 115/16 |
| 4,056,073 | 11/1977 | Dashew et al. | 114/151 |

*Primary Examiner*—Trygve M. Blix
*Assistant Examiner*—Jesus D. Sotelo
*Attorney, Agent, or Firm*—Freilich, Hornbaker, Wasserman, Rosen & Fernandez

[57] ABSTRACT

An improved boat thruster including a diverter valve having an inlet connected to a water pump and a pair of outlets extending to either side of the boat. Each outlet includes a primary nozzle and a deflector movable to a first position wherein it allows water flow from the primary nozzle to be discharged to one side to thus thrust the boat to the opposite side. Each deflector is also movable to second and third positions for directing the primary nozzle water flow to respective secondary nozzles for discharging the water either forwardly or rearwardly to thus thrust the boat in the opposite direction. The secondary nozzles each have an exit area smaller than that of the primary nozzle.

10 Claims, 19 Drawing Figures

Fig. 1
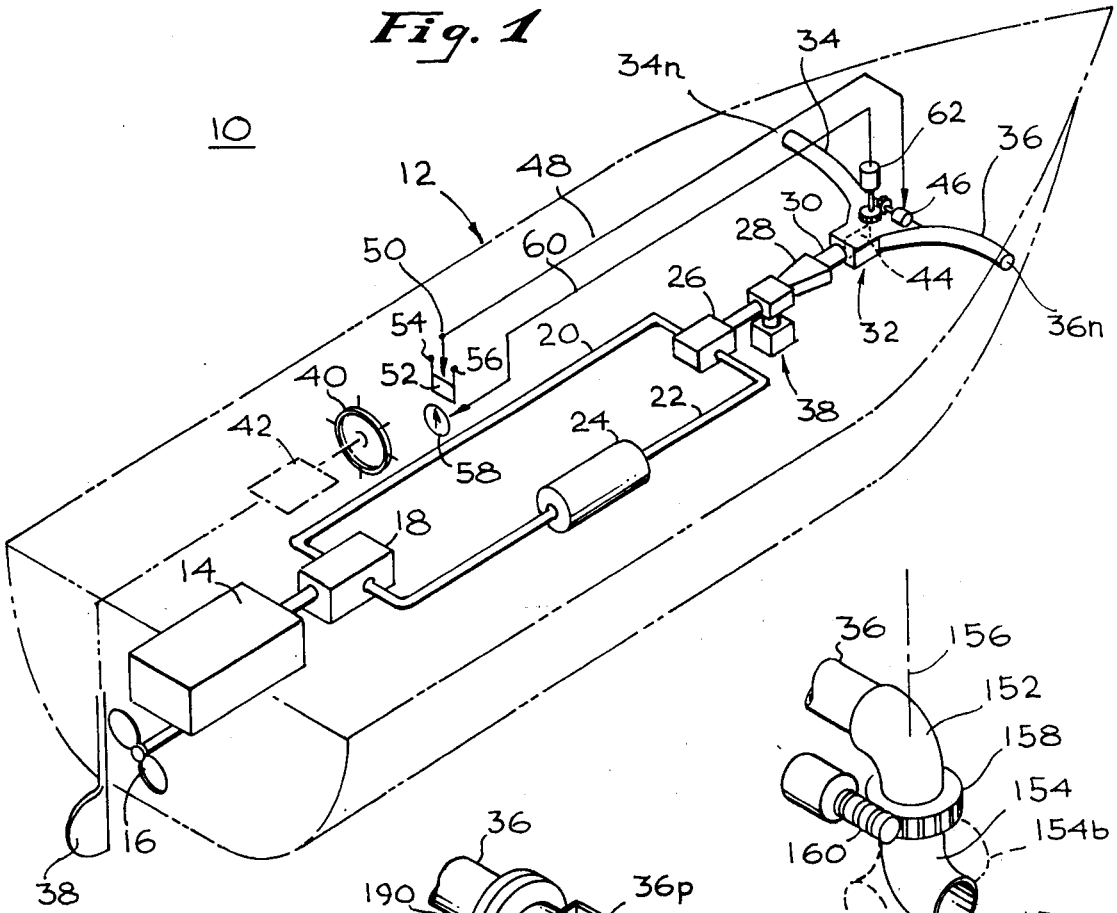
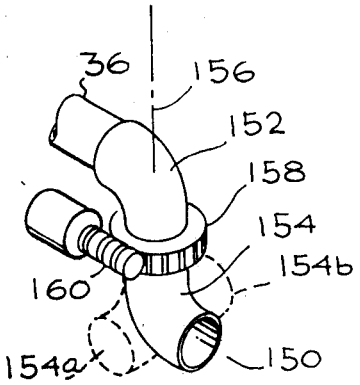
Fig. 2
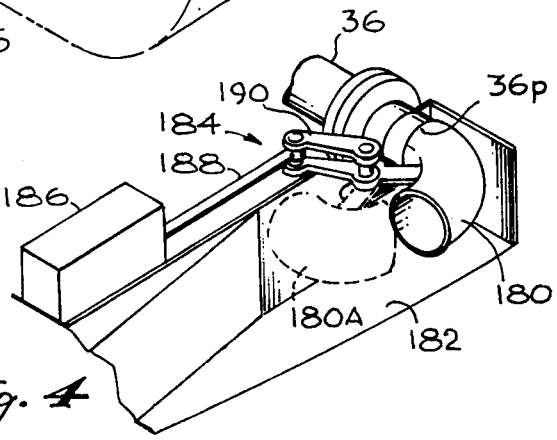
Fig. 4
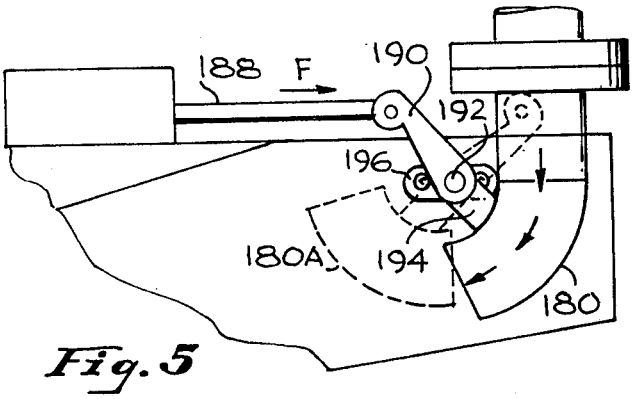
Fig. 5
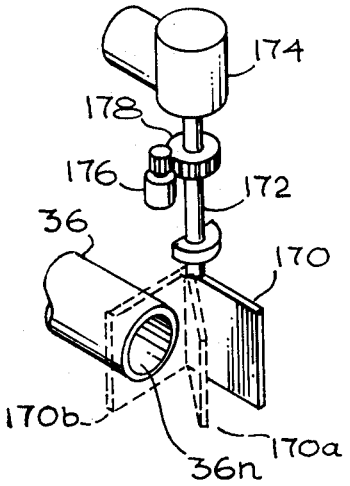
Fig. 3

BOAT THRUSTER

CROSS-REFERENCE

This is a continuation-in-part of U.S. patent application Ser. No. 664,871, filed Mar. 8, 1976, now U.S. Pat. No. 4,056,073 which in turn was a continuation-in-part of U.S. patent application Ser. No. 491,797, filed July 25, 1974, now abandoned.

BACKGROUND OF THE INVENTION

Applicant's parent application Ser. No. 664,871 discloses a boat thruster which permits conversion from sideward bow thrusting to forward or rearward thrusting, in a simple and efficient manner. The apparatus includes an inlet connected to a high-capacity water pump, a pair of outlets extending to either side of the boat at the bow, valve means for controlling the amount of water allowed to pass through the pair of outlets and a deflector at each outlet. The deflector can be moved between positions wherein (1) it allows sideward water discharge to thrust the bow to the side, (2) it directs water rearwardly to move the boat in a forward direction or (3) it directs water forwardly to move the boat in a rearward direction.

In accordance with the present invention, each of the aforementioned outlets is comprised of a primary nozzle directed to the side and at least one secondary nozzle directed fore or aft together with flow deflector means for selectively discharging a water flow directly from said primary nozzle or from said primary nozzle through said secondary nozzle.

In accordance with a further embodiment of the invention, the secondary nozzle has an exit area smaller than that of the primary nozzle to enable the pump to operate at high efficiency whether it is driving one outlet for side thrust or both outlets for fore or aft thrust.

The novel features that are considered characteristic of this invention are set forth with particularity in the appended claims. The invention will best be understood from the following description when read in connection with the accompanying drawings.

BRIEF DESCRIPTION OF THE DRAWING

FIG. 1 is a perspective view of a bow thruster system of the invention mounted on a boat;

FIG. 2 is a partial perspective view of the apparatus of FIG. 1;

FIG. 3 is a partial perspective view of a thruster deflector apparatus constructed in accordance with another embodiment of the invention;

FIG. 4 is a perspective view of a thruster deflector apparatus constructed in accordance with another embodiment of the invention;

FIG. 5 is a plan view of the apparatus of FIG. 4;

DESCRIPTION OF THE PREFERRED EMBODIMENTS

Figure 7:
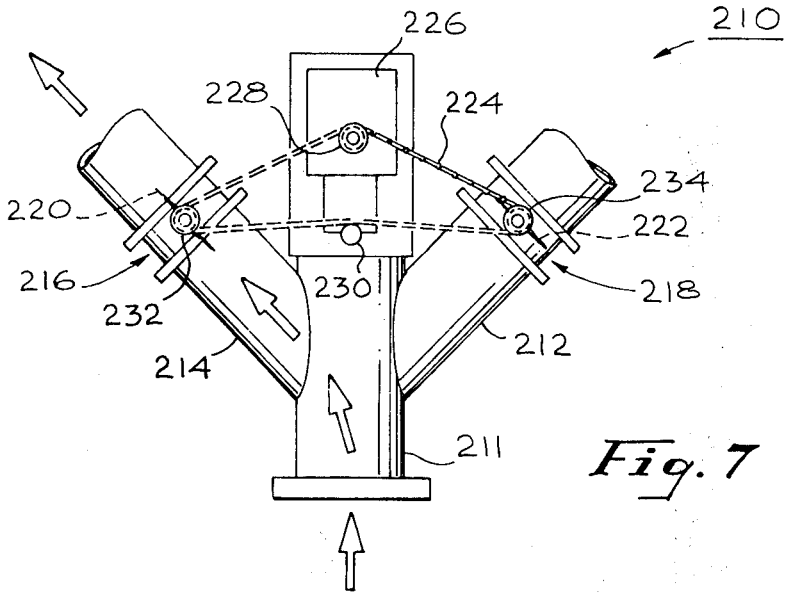
FIGS. 7 and 8 are schematic plan views showing two positions of a preferred diverter valve means.

FIGS. 1–10 correspond identically to FIGS. 1–10 of said parent application Ser. No. 664,871, now U.S. Pat. No. 4,056,073.

FIG. 1 illustrates a bow thruster system 10 in the hull of a boat 12 for facilitating maneuvering of the boat. The system includes an engine 14 located in the rear half or stern portion of the boat and is utilized primarily to drive the main boat propulsion which may be a propeller 16 or a water jet thruster. The engine is connected to an hydraulic pump 18 which pumps hydraulic fluid through a pair of hydraulic lines 20, 22 that include a cooler 24 and that carry the hydraulic fluid through an hydraulic motor 26 located in the bow portion of the hull. The hydraulic motor 26 drives a high-capacity water pump 28 whose output 30 is connected to a diverter valve 32. The diverter valve means is connected to port and starboard lines 34, 36 that lead to opposite sides of the boat at the bow portion thereof. Water enters the system through an inlet assembly 38, and emerges as a jet stream from either or both of a pair of thruster nozzles **34*n*, 36*n*, at the ends of the lines 34, 36. The emerging water can be utilized to push the bow to either side, to thereby turn the boat or make other maneuvers. This manner of steering is provided in addition to conventional steering by a rudder 39 which can be pivoted by a steering control or wheel 40 located at the wheel house or control station 42** on the boat. Although the main propulsion engine of the boat may be utilized for powering the bow thrusters, it should be noted that auxiliary engines used to generate electricity often may be used instead.

The diverter valve 32 of the bow thruster controls the flow of water between the port and starboard lines 34, 36 by the use of a valve means such as a vane device 44. The vane device is pivoted by a suitable motor 46 which can be energized to rotate in either of two directions. The motor is energized by current received over conductors 48 that extend through a switch 50 to a power source 52. The switch 50 can be left in a neutral position to de-energize the motor or can be moved to either of two contacts 54, 56 to energize the motor 46 in opposite directions to pivot the vane device 44. The pivotable position of the vane device 44 is constantly indicated by a position indicator or meter 58. The meter 59 is connected through a line 60 to a potentiometer 62 that is connected to the shaft of the pivotable vane device 44. Both the control switch 50 and indicator 58 are located at the control station 42 in the rear portion of the boat, so that they are accessible to a person stationed there who is operating the wheel 40 and engine controls (not shown). The operator at the control station can move the rudder 38 and vane 44 to extreme positions at both the bow and stern to move the boat sideways without turning, or cause it to execute a very sharp turn.

The versatility of the bow thruster system can be increased by providing means for deflecting water emerging from the thruster outlets in a variety of directions instead of just sidewardly. FIG. 2 illustrates a thruster nozzle assembly 150 which includes a first elbow 152 for diverting water from the starboard line 36 into a downward direction and a moveable second elbow 154 which diverts the water into a horizontal direction. The second elbow 154 is pivotably mounted about a vertical axis 156 on the first elbow so that the second elbow can be pivoted from the position shown in solid lines wherein its discharges water laterally to thrust the bow to one side, to a second position indicated at 154*a* wherein it discharges water rearwardly to propel the boat forwardly, and to a third position indicated at 154*b* wherein it discharges water forwardly to move the boat to the rear. In order to permit controlled movement of the second elbow-nozzle device 154, a worm wheel 158 is fixed to the nozzle 154 and a worm 160 is engaged with the worm wheel and is driven by a motor to turn the nozzle.

FIG. 3 illustrates another arrangement for deflecting the water emitted from the starboard line 36, which includes a pivotably mounted thruster vane positioned at the starboard line end or nozzle 36*n*. The thruster vane 170 can pivot from the position shown in solid lines in FIG. 3 wherein it allows water to move sidewardly to produce a sideward thrust on the boat, or can be pivoted to a position 170*a* wherein it deflects the issuing water to a rearward direction to provide forward thrust to the boat. The vane 170 is mounted on the shaft 172 which can be turned by a gear motor 174. A potentiometer 176 coupled by gears 178 to the vane shaft indicates the position of the vane 170 at a remote meter which may be located at the control station of the boat. The thruster vane 170 also can be pivoted to a position 170*b* wherein it sealingly covers the water line 36, to thereby provide a shutoff valve that prevents the inflow of water when repair work is to be done on the thruster system.

FIGS. 4 and 5 illustrate another arrangement for deflecting the water emitted from one of the lines such as starboard line 36. The apparatus includes a deflector means in the form of a secondary deflector nozzle 180 which can direct water emanating from the outlet nozzle 36*p* into a largely rearward direction to propel the boat. The nozzle 180 can be selectively moved from the operative position shown by solid line in FIGS. 4 and 5 to an inoperative position 180A shown in dashed line where it is out of line with the outlet nozzle 36*p*, to permit sideward thrusting of the bow of the boat. The nozzle 180 lies in a recess 182 formed in the side of the bow, so that the nozzle is protected. The recess has a deep forward portion adjacent the outlet nozzle 36*p*, and is rearwardly tapered in depth. A driving mechanism 184 is provided to move the nozzle 180 between the operative position shown in solid line in FIGS. 4 and 5 and the inoperative position 180A shown in dashed line.

The nozzle 180 is in the form of a pipe including a bend of approximately 75°. When in the operative position, the nozzle 180 efficiently changes the directions of the pumped water, so that there is very little loss of power in passage through the nozzle. When the nozzle is in the inoperative position 180A wherein it is out of line with the outlet 36*p*, water is emitted directly from the outlet 36*p* without any power loss from the nozzle. The possibility of binding of the nozzle is minimized because there is no rotational joint about which the nozzle turns about its axis, as in the case of the elbow 154 of FIG. 2. There are pivot joints in the mechanism 184 that moves the nozzle, but these are simpler and of smaller diameter, and therefore less likely to bind.

The mechanism 184 that pivots the nozzle 180 includes an electrically energized gear motor 186 which drives a rod 188 forward and backward. The forward end of the rod is pivotably connected to one end of arms 190 whose other ends are fixed to shaft 192 that are, in turn, connected by arms 194 to nozzle 180. The shaft 192 is pivotably mounted on a bracket 196 that is fixed to the boat. When the motor 186 moves the rod forward in the direction of arrow F, the nozzle is pivoted to position 180A, and when the rod is moved back the nozzle is moved to position 180.

Figure 6:
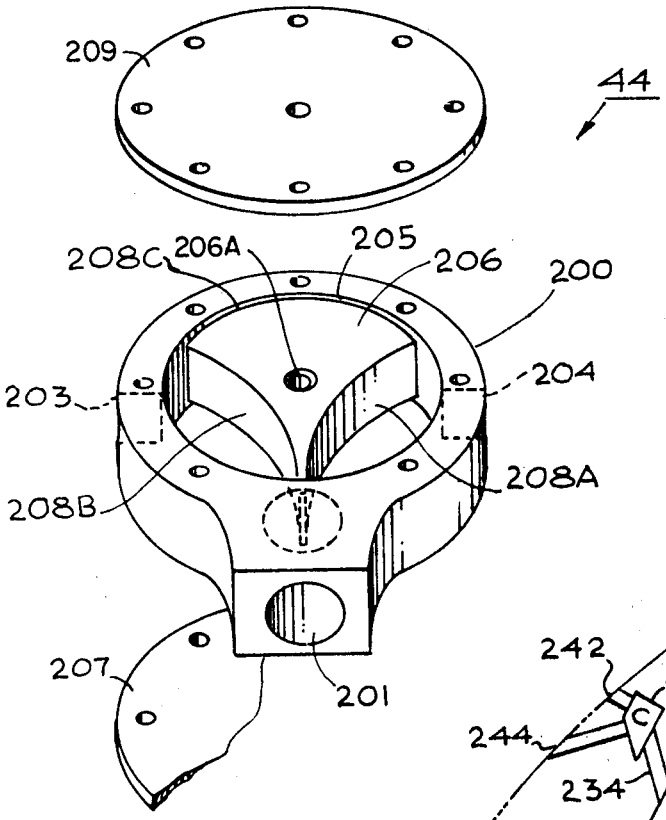
FIG. 6 is a perspective view of a vane device valve means suitable for use with the invention.

FIG. 6 is a perspective view of a suitable vane device 44 for controlling water flow from the pump through the port and starboard lines. The vane device comprises a housing 200, having an inlet passage 201 which connects to the pump outlet 30, and two outlet passages, respectively 203, 204, respectively connected to the respective lines 34, 36. The housing contains a central circular cavity 205 wherein there is pivotably supported a substantially wedge-shaped vane 206. Top and bottom plates respectively 209 and 209[1] are shown for sealing the central cavity 205.

It should be noted that the vane 206 is rotatable about its center 208 which is a beveled opening into which is inserted a shaft, not shown, for the purpose of positioning the vane. The vane has two inwardly curved surfaces, 208A, B, which flare out to an outwardly curved back surface 208C.

Placing the vane positioning axis at its center, instead of at one end as has been done heretofore, and curving the vane surfaces, instead of using flat surfaces, has the effect of reducing considerably the power that is required to be applied to move the vane to a desired position against the forces being applied by the water stream. If one analogizes a vane and its positioner as a lever and fulcrum, with previously known vanes, the fulcrum is at one end and the force "f" against which it must act may be considered a distance "x" away toward the other end. By moving the fulcrum to the center of the vane and curving the vane surfaces, the forces against which the vane must act are applied to its surfaces on both sides of the fulcrum in varying degrees as the vane is rotated. Thereby, the distance of application of the force against which the vane must move is notably reduced but a force is also applied to the vane on the other side of the fulcrum which aids in overcoming the force against which the vane must move. Because of the resulting reduction in power required of the vane positioning motor, there is also a resulting reduction in the size and cost of the motor required to move the vane.

Figure 8:
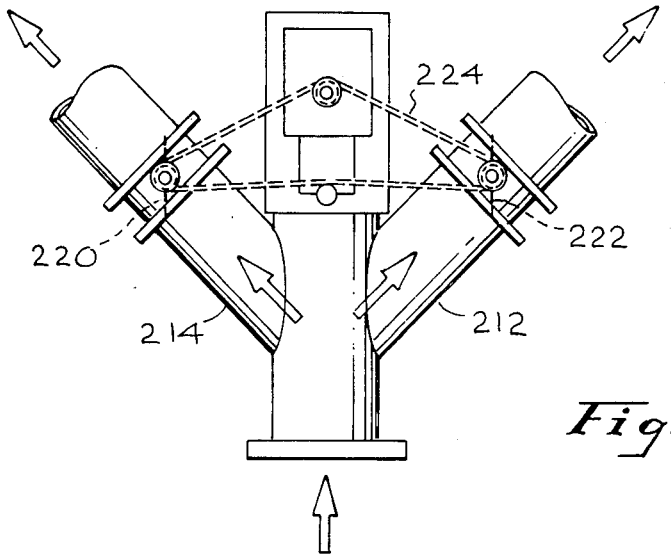
Figure 9:
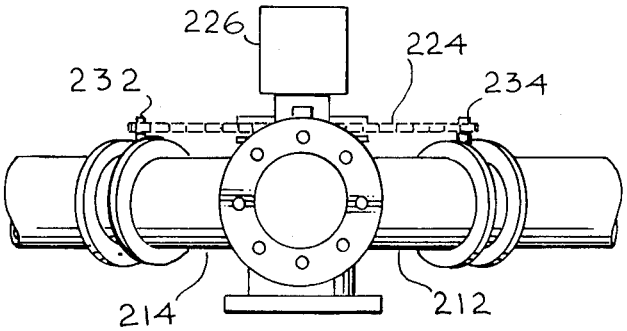
FIG. 9 is a view, in elevation, of the preferred diverter valve means looking into the flow inlet.

FIGS. 7, 8 and 9 are respectively two plan views and a view in elevation of a preferred arrangement 210 for the diverter valve 32 of FIG. 1. It includes an inlet pipe 211 which connects to the pump output 30. The respective outlet pipes 212, 214 respectively connect to outlet lines 34, 36. Within each outlet pipe there is a butterfly valve respectively 216, 218, each of which has a pivotably supported vane respectively 220, 222. Both vanes are simultaneously moved by means of a drive chain 224.

A motor 226, which may be controlled in the manner described for the motor 46 in FIG. 1, drives a drive sprocket gear 228. The chain 224 is engaged by the drive sprocket gear 228. The chain 224 is engaged by the drive sprocket gear and three other sprocket gears which include an idler gear 230 and two gears respectively 232, 234 which actuate the respective vanes 220, 222.

FIG. 7 shows the vanes positioned so that the starboard line is open and water will flow therethrough, and the port line is closed. FIG. 8 shows the vanes positioned in their half-open positions. The vanes can assume all positions from the one with the starboard line closed and the port line open to the one with the starboard line open and the port line closed.

The advantages of the diverter valve system 210 shown in FIGS. 7, 8 and 9 over all previous systems is that it enables a precision control of the thruster system not attainable heretofore. It enables proportional control of the two water streams and thereby proportional thrusting. Most boat thruster systems are designed to turn the water streams on or off because they are meant to push a boat left or right. The system described hereinabove is actually a bow steering system for which proportional thrusting is required. The on-off boat thruster systems provide an action such as is obtained by swinging a rudder from full left to full right, which causes very erratic oversteering.

If the boat thruster system is to be controlled by an automatic pilot, it is important that the system be capable of rapid minute changes, such as are obtainable with the system described, otherwise the vessel would steer an erratic course. The same is true if the boat thruster system is to be used for boat position-keeping where wind and wave are such that a large thrust on one side of the boat and a lesser thrust on the other are required to maintain a desired boat heading and position.

The combination of the proportional thrusting arrangement and either the nozzle assembly or thruster vane assembly described herein enable accurate position-keeping; again, wind and tide can be such as to require minute heading adjustments, obtainable only by a combination of aft thrusting on one side of the boat and side thrusting on the other.

In prior art boat thrust systems where some kind of proportional or side-to-side thrusting was desired, the skipper of the boat would position his vane deflector and change the pump speed. This adds another burden to a skipper, already burdened with controlling engine speed. Further, a controllable variable speed pump is more expensive than a single speed pump which is all that is required with the proportional boat thrust system provided by this invention.

Figure 10:
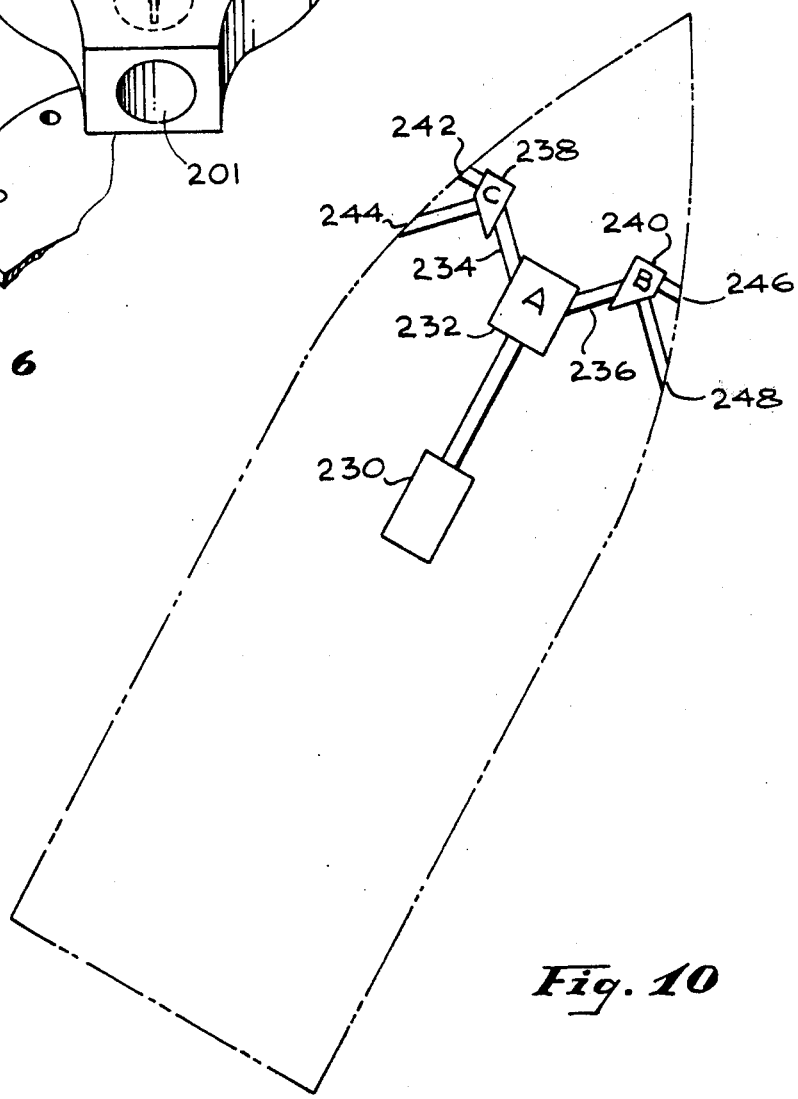
FIG. 10 is a schematic drawing of another embodiment of the invention.

FIG. 10 is a schematic view of still another embodiment of the invention. In the boat hull there is positioned a pump 230 whose output is connected through a passageway to first manifold, which contains a diverter valve, such as is shown in FIG. 6 or FIG. 7. The first manifold 232 is connected through two pipes respectively 234, 236, to second and third manifolds, respectively 238, 240. Each of the manifolds include diverter valves, such as is shown in FIG. 6 or FIG. 7. The outlet pipes respectively 242, 244 extend from manifold 238 to and through the hull of the boat. Two outlet pipes respectively 246, 248 extend from manifold 240 to and through the hull of the boat.

The outlet pipes 242 and 246 extend sidewards through the hull and water flowing through either produces a sidewards thrust; or through both can be used, under certain circumstances, for position-keeping. The outlet pipes 244, 248 extend rearwardly and water flowing through either produces turning; or through both produces forward propulsion. For rearward propulsion, a vane device can be positioned adjacent each pair of outlet pipe openings so that the water coming out of an outlet pipe can be diverted forwardly and thereby propel the boat rearwardly.

The vane device in manifold 232 is used to control the amount of water flowing to either set of outlet pipes and therefore the amount of thrust resulting. It can therefore be used to determine steering. The vane devices in manifolds 238 and 240 are used to determine which of the respective outlet pipes are open and which are closed. They thereby determine whether the boat will move forward or sidewards.

From what has been said thus far, it should be appreciated that the various thruster configurations disclosed herein operate to direct a flow of water of a certain mass through a change of velocity. The change of velocity or acceleration occurs through the nozzle, e.g. **36*n* of FIG. 1 or 36*p* of FIG. 4**. When the direction of exit flow from the nozzle is either forward, aft, or beam, motion thrust is produced which develops a reaction force causing motion of the bow in a direction opposite to the exit flow.

The pump 28 producing the water flow should, for the various modes of operation, preferably operate at a set point on its performance curve to produce maximum thrust. Some of the factors that affect this point are pump horsepower, RPM, and the effective nozzle exit area seen by the pump. In accordance with a preferred embodiment of the invention, the system is designed such that the pump operates close to its optimal set point when the Y or diverter valve 32 (FIG. 1), 210 (FIGS. 7, 8, 9) is positioned such that one outlet is fully open and the other outlet is fully closed. This condition directs full flow through one nozzle having a certain exit area to produce maximum thrust. When the diverter valve (hereinafter sometimes called "main valve") goes to the neutral position, the flow is diverted to both outlets and the pump sees an effective exit area equal to the sum of the two nozzle exit areas. When this neutral condition occurs, the pump operating point drops on its performance curve, the pressure of the system drops and the total thrust produced by the pump is reduced. This reduction in thrust causes no problem if it is merely intended to produce beam thrust to maintain the position of the boat. However, if the main valve is in the neutral position for the purpose of diverting water flow to both outlets to produce fore or aft thrust, then the thrust reduction represents a severe penalty.

In accordance with the present invention, in order to avoid the aforementioned reduction in thrust when the main valve is in the neutral position and it is desired to develop fore or aft thrust, the water flow through each outlet is diverted through successive nozzles which present an effective exit area enabling the pump to operate at its optimal set point.

Figure 17:
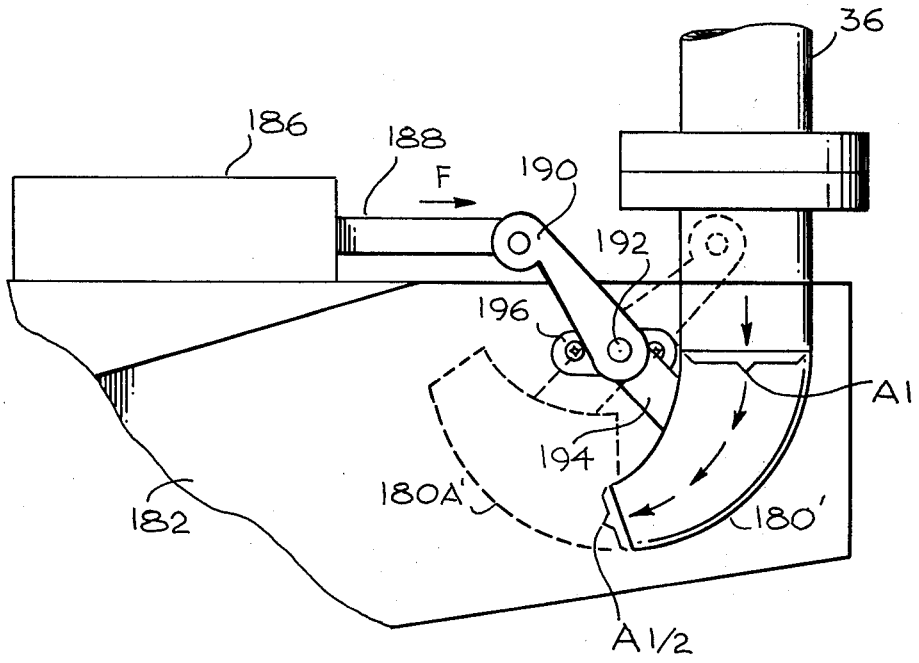
FIG. 17 is a plan view of an apparatus similar to FIG. 5 but modified in accordance with the present invention.

More particularly, considering the embodiment of FIGS. 4 and 5, for example, associated with each outlet is a primary nozzle **36*p* and a secondary nozzle 180. If the exit area presented by the primary starboard nozzle is represented by A1, and the exit area presented by the primary port nozzle is represented by A2, then with the main valve in the neutral position and the secondary nozzles 180 in the inoperative position, the pump sees an effective exit area equal to A1+A2 or, since A1=A2, 2A1. As has previously been mentioned, the system is designed to produce maximum thrust when one outlet is fully open and the other fully closed; i.e., when the effective pump exit area equals A1. In accordance with the present invention, in order to present an effective exit area A1 when the main valve is in a neutral position to produce fore and aft thrust, the secondary nozzles 180 are selected so as to define an exit area A1/2 as represented in FIG. 17**. Thus, with the main valve in the neutral position and both secondary nozzles in an operative position, the pump will see an effective area equal to twice the area of each secondary nozzle exit area; i.e., a total area A1. Accordingly, the pump can produce maximum thrust.

Figure 11:
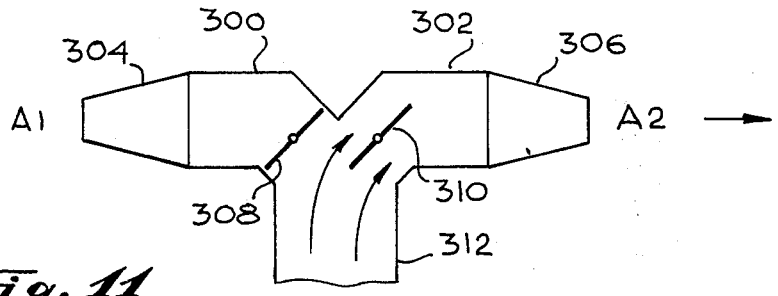
FIG. 11 schematically illustrates a basic thruster system including first and second outlets.

Attention is now directed to FIG. 11 which schematically represents a basic thruster system including first and second outlets 300, 302 respectively terminating in nozzles 304, 306. The nozzles 304, 306 define equal exit areas A1, A2. A main valve comprised of pivotably-supported vanes 308, 310 (as previously discussed in connection with FIGS. 7–9) is incorporated in the outlets 300, 302 for proportioning the flow from the inlet pipe 312 to the nozzles 304, 306.

With vane 308 closed and vane 310 open, the flow from pipe 312 will exit through nozzle 306 and the pump will see an effective exit area A2, meaning that it will be producing maximum thrust, as aforedescribed, to move the boat toward port. An opposite orientation of the vanes 308 and 310 will produce maximum thrust in the opposite direction to move the boat toward starboard.

Figure 12:
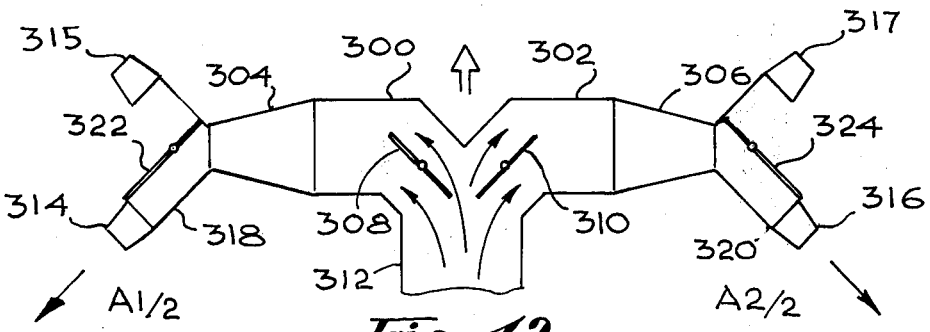
FIGS. 12 and 13 schematically illustrate the basic system of FIG. 11 further including secondary nozzles.

FIG. 12 schematically illustrates the thruster system of FIG. 11 with secondary nozzles 314 and 316 respectively mounted to receive the flow from primary nozzles 304, 306 to divert it aft and with secondary nozzles 315 and 317 respectively mounted to receive the flow from primary nozzles 304, 306 to divert it forward. The secondary nozzles 314 and 315 are coupled to primary nozzle 304 by flow path means 318. Similarly, the secondary nozzles 316 and 317 are coupled to primary nozzle 306 by flow path means 320. The flow path means 318, 320 respectively include pivotable vanes 322, 324 which in a first position (illustrated in FIG. 12) steer the flow from the primary to the secondary nozzles 314, 316 and in a second position (FIG. 13) permit the primary nozzle flow to discharge sidewardly directly to the sea.

In accordance with the present invention, the secondary nozzles 314 and 315 each define exit areas A1/2 and the secondary nozzles 316, 317 each define exit areas A2/2. Thus, with both main valve vanes 308, 310 open and with vanes 322, 324 oriented to divert the flow through the secondary nozzles 314, 316, the pump will see an effective exit area equal A1/2 +A2/2=A1 (assuming A1=A2) thus enabling the pump to provide maximum thrust to propel the boat in a forward direction. Similarly, with vanes 322, 324 oriented to divert the flow through the secondary nozzles 315, 317, the pump will also see an effective exit area equal A1 thus enabling the pump to provide maximum thrust for propelling the boat rearwardly.

Figure 13:
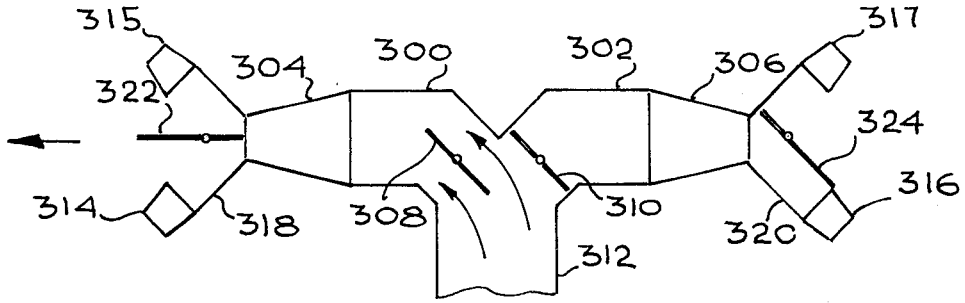

FIG. 13 illustrates the vane configuration to enable the pump to provide maximum thrust to move the boat toward starboard. An opposite orientation of vanes 308, 310, 322, 324 will propel the boat toward port.

Figure 14:
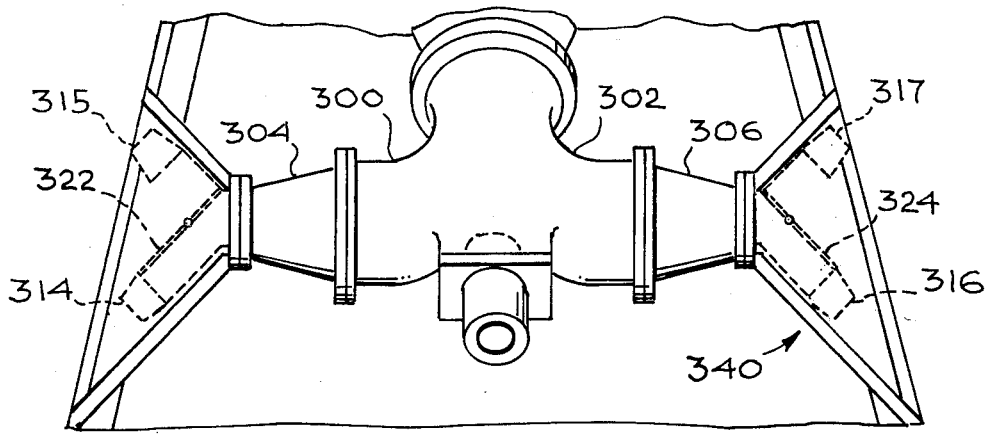
FIG. 14 is a perspective view of a structure conforming to the representations of FIGS. 12 and 13.
Figure 15:
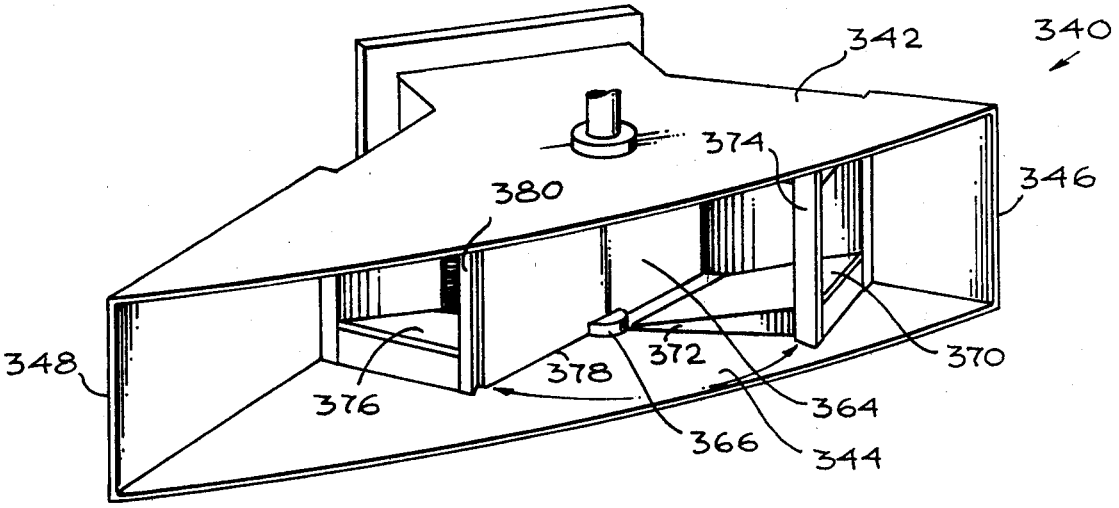
FIG. 15 is an enlarged perspective view showing the deflector and secondary nozzle structure of FIG. 14.

FIGS. 14, 15 and 16 illustrate a preferred configuration of a deflector valve and secondary nozzle assembly 340 in accordance with the present invention. The assembly 340 is comprised of a housing defined by upper and lower walls 342 and 344 and end walls 346 and 348. All of the walls 342, 344, 346, and 348 are structurally connected to a flange 350 which, in use, is secured to a flange 352 mounted at the exit of the primary nozzle, e.g. 306. The housing defines a cavity having an entrance opening 356 in communication with the exit opening of the primary nozzle and an exit opening 360 which communicates with the sea. A deflector vane 364 is mounted within the housing between the walls 342 and 344 for pivotal movement around a central axis 366.

Figure 16C:
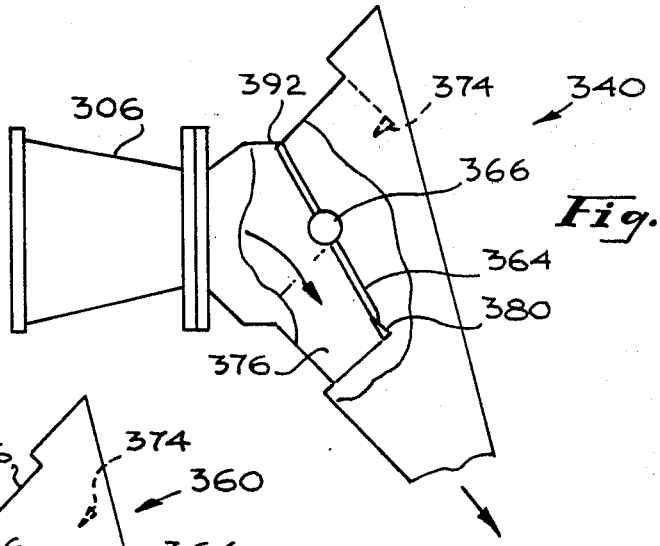
FIGS. 16A, 16B, 16C are plan views showing the deflector and secondary nozzle structure for each of the three deflector positions.
Figure 16A:
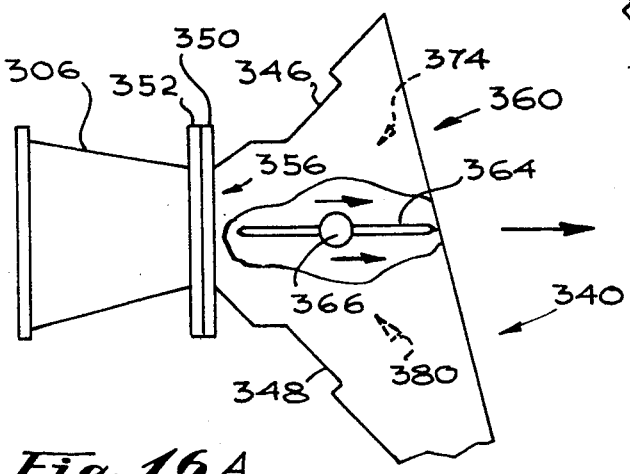
Figure 16B:
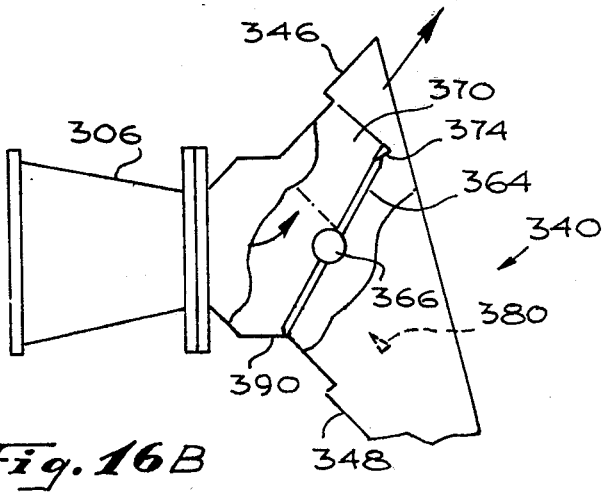

The deflector vane 364 is selectively moveable between the positions respectively shown in FIGS. 16A, 16B and 16C. FIG. 16A illustrates the deflector vane 364 in a neutral position whereat it permits the water flow from the primary nozzle 306 to discharge sidewardly directly to the sea to produce a sideward thrust on the boat. FIG. 16B illustrates the deflector vane 364 pivoted to a position to direct the water flow from the primary nozzle 306 in a forward direction to thus propel the boat rearwardly. FIG. 16C illustrates the deflector vane 364 pivoted so as to direct the water flow from the primary nozzle in a rearward direction to propel the boat forwardly.

In the orientations of the deflector vane illustrated in FIGS. 16B and 16C, the water flow is of course being directed from the primary nozzle 306 through secondary nozzles prior to being discharged to the sea. As previously pointed out, it is desirable that the secondary nozzles define an exit area equal to substantially one-half of the exit area defined by the primary nozzle. The secondary nozzles are formed in the assembly 340 by the deflector vane 364 acting in conjunction with fixed surfaces contained within the assembly housing. More particularly, the secondary nozzle for discharging the water in a forward direction, corresponding to secondary nozzle 317 of FIG. 13, is formed by upper and lower ramp members 370 respectively mounted in opposed relationship on the inner surfaces of walls 342 and 344. The ramp members are inclined toward each other and cooperate with the side wall 346 and vane 364 to define a nozzle. Sealing strips 372 are mounted in opposed relationship on the inner surfaces of walls 342 and 344 adjacent the ramps 370 to seal against the bottom edge of the vane 364 to prevent leakage. Similarly, a sealing strip 374 extending between the wall 342 and 344 is mounted so as to engage the forward edge of the vane 364.

The secondary nozzle for directing a water flow rearwardly and corresponding essentially to secondary nozzle 316 of FIG. 13 is formed between the deflector vane 364 and the end wall 348. Ramps 376 cooperate with the deflector vane 364 and the end wall 348 to define the rearwardly directed nozzle. Sealing strips 378 on the inner surfaces of walls 342 and 344 are provided adjacent the ramps 376 to seal the bottom edge of the deflector vane 364. Similarly, a vertical sealing strip 380 corresponding to previously mentioned sealing strip 374 is mounted adjacent the ramps 376 between the walls 342 and 344.

Note that when the deflector vane is pivoted to the position illustrated in FIG. 16B, its outer edge engages sealing strip 374 and its inner edge engages shoulder 390 on wall 348. When the deflector vane 364 is in the position illustrated in FIG. 16C the outer edge of the deflector vane engages sealer strip 380 and its inner edge engages shoulder 392 on end wall 346. The inner and outer edges of the deflector vane 364 are configured so as to appropriately seal to the respective sealing strips and shoulders. That is, the oppositely facing surfaces of the vane 364 are inclined toward one another adjacent the vane edges so as to mate well with complementary formed surfaces on the sealing strips and shoulders.

Accordingly, the present invention provides a novel and useful boat thrust system which enables accurate steering, boat position-keeping, as well as the use of an automatic pilot, while reducing the cost of the pump and vane control systems.

Although particular embodiments of the invention have been described and illustrated herein, it is recognized that modifications and equivalents may readily occur to those skilled in the art and consequently, it is intended that the claims be interpreted to cover such modifications and equivalents.

What is claimed is:

1. In combination with a boat having a hull with bow and stern portions, the improvement comprising:

pump means mounted in said hull for pumping water; and thruster means having a common passage coupled to said pump means, for receiving the water pumped thereby, said common passage connecting to two thruster outlet means opening to the seat at either side of the bow of the hull for discharging water into the sea thereat;

said boat hull having a recess on either side of said bow, said recess having a deep forward portion and being tapered in depth to have a progressively smaller recess depth at progressively more rearward locations;

each of said thruster outlet means including diverter means selectively operable to assume different desired positions to direct water being discharged in different directions for position holding, steering or propelling said boat;

said thruster outlet means including a sidewardly opening outlet at said forward portion of said recess, said diverter means including a movable member lying in said recess;

a primary nozzle mounted at each thruster outlet means opening having an exit area A;

a secondary nozzle mounted proximate to each of said primary nozzles having an exit area substantially equal to A/2; and valve means for selectively directing the flow from each primary nozzle to the sea or to the secondary nozzle mounted proximate thereto.

2. The combination of claim 1 wherein said secondary nozzles are oriented to discharge a water flow to the sea in a direction having a component parallel to a line between the bow and stern.

3. The combination of claim 1 wherein said secondary nozzles are oriented to discharge a water flow to the sea in a direction extending forwardly toward said bow.

4. The combination of claim 1 wherein said secondary nozzles are oriented to discharge a water flow to the sea in a direction extending rearwardly toward said stern.

5. In combination with a boat having a hull with bow and stern portions, the improvement comprising:

pump means mounted in said hull for pumping water; and thruster means having a common passage coupled to said pump means, for receiving the water pumped thereby, said common passage connecting to two thruster outlet means opening to the sea at either side of the bow of the hull for discharging water into the sea thereat;

each of said thruster outlet means including diverter mean selectively operable to assume different desired positions to direct water being discharged in different directions for position holding, steering or propelling said boat, said hull having a recess at either side of the bow thereof, each of said thruster outlet means including an outlet lying in a corresponding recess and oriented to direct water in a primarily sideward direction from said recess; and said diverter means including a nozzle having opposite ends and being curved by at least 45°, and means for selectively moving said nozzle with an end thereof against said outlet to direct water exiting from said outlet into a primarily rearward direction, and for moving said nozzle away from said outlet to allow water to exit into the sea in a primarily sideward direction;

each of said thruster outlet means including a primary nozzle having an exit area A; and wherein said diverter means nozzle has an exit area substantially equal to A/2.

6. In combination with a boat having a hull with bow and stern portions, the improvement comprising:

pump means mounted in said hull for pumping water;

thruster means having a common passage coupled to said pump means, for receiving the water pumped thereby, said common passage connecting to two thruster outlet means opening to the sea at either side of the hull for discharging water into the sea thereat;

main valve means incorporated in said thruster means for selectively proportioning the water flow to each of said thruster outlet means;

primary nozzle means mounted in each of said thruster outlet means for discharging a water flow through an exit area A sidewardly substantially perpendicular to the longitudinal axis of said hull;

secondary nozzle means mounted proximate to each of said primary nozzle means for discharging a water flow through an exit area equal to approximately one-half A in a direction having a component parallel to said longitudinal axis; and secondary valve means for selectively directing the flow from each primary nozzle means directly to the sea such that said flow enters the sea in a sideward direction substantially perpendicular to the longitudinal axis of said hull or to the secondary nozzle means mounted proximate thereto.

7. The combination of claim 6 wherein each of said secondary nozzle means includes first and second secondary nozzles each having an exit area equal to approximately one-half A; and wherein said secondary valve means includes further means for selectively directing said primary nozzle means flows to either said first or said second secondary nozzle.

8. The combination of claim 7 wherein said first and second secondary nozzles are respectively oriented to discharge a water flow forwardly toward said bow and rearwardly toward said stern.

9. In combination with a boat having a hull with bow and stern portions, the improvement comprising:

pump means mounted in said hull for pumping water; and thruster means having a common passage coupled to said pump means, for receiving the water pumped thereby, said common passage connecting to two thruster outlet means opening to the sea at either side of the hull for discharging water into the sea thereat;

primary nozzle means mounted in each of said thruster outlet means for discharging a water flow through an exit area A sidewardly substantially perpendicular to the longitudinal axis of said hull;

secondary nozzle means mounted in each of said thruster outlet means for discharging a water flow through an exit area equal to approximately one-half A in a direction having a component parallel to said longitudinal axis; and valve means for selectively directing the flow from said pump means to discharge the flow to the sea through said primary nozzle means or through said secondary nozzle means.

10. The combination of claim 9 wherein each of said secondary nozzle means includes first and second secondary nozzles each having an exit area equal to approximately one-half A; and wherein said valve means includes means for selectively directing said flow to either said first or secondary nozzles.

* * * * *